United States Patent [19]

Acres

[11] 4,295,582

[45] Oct. 20, 1981

[54] DISPENSING CONTAINER WITH IMPROVED AIR VALVE

[76] Inventor: Alexander D. Acres, 368 Glenrose Dr., London, Ontario, Canada, N6K 2A8

[21] Appl. No.: 65,269

[22] Filed: Aug. 9, 1979

[51] Int. Cl.[3] ..... B65D 37/00

[52] U.S. Cl. ..... 222/213; 222/386.5; 141/27

[58] Field of Search ..... 222/206, 209, 214, 213, 222/215, 386.5, 478, 490, 491, 189; 141/1, 25, 27, 29, 7, 8, 10; 215/11.E, 307

[56] References Cited

U.S. PATENT DOCUMENTS

| | | | |
|---|---|---|---|
| 1,607,993 | 11/1926 | Loewy | 222/490 |
| 2,349,594 | 5/1944 | McMahan | 141/7 |
| 2,679,336 | 5/1954 | Frick | 222/386.5 |
| 3,134,494 | 5/1964 | Quinn | 215/11 E |
| 3,215,319 | 11/1965 | Laker | 222/213 |
| 3,319,837 | 5/1967 | Mueller | 222/386.5 |

*Primary Examiner*—H. Grant Skaggs

*Attorney, Agent, or Firm*—Finnegan, Henderson, Farabow, Garrett & Dunner

[57] ABSTRACT

A resiliently squeezable container is disclosed which is partitioned by a resilient deformable membrane into two chambers, an ingredient chamber, which communicates through an ingredient discharge orifice to the outside, and an air chamber which communicates through a simplistic reclosable valve to the ambient atmosphere. The reclosable valve is such that the pressure within each chamber is held in equilibrium. Thus, on squeezing of the container ingredients are exuded from the ingredient chamber and on release of the container (recovery) air enters through the reclosable valve into the air chamber to re-establish equilibrium between chambers within the container. Thus, by cyclically squeezing and releasing the container, ingredients in the container are instantaneously discharged during each squeeze portion of the cycle. The invention resides in the reclosable air valve which utilizes as the movable element of the valve a portion of the resilient deformable membrane. Also disclosed are novel ingredient discharge orifices which prevent air from entering the ingredient chamber.

5 Claims, 16 Drawing Figures

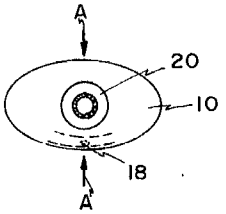
FIG. 4
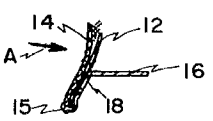
FIG. 5
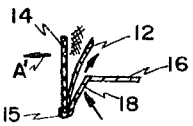
FIG. 6
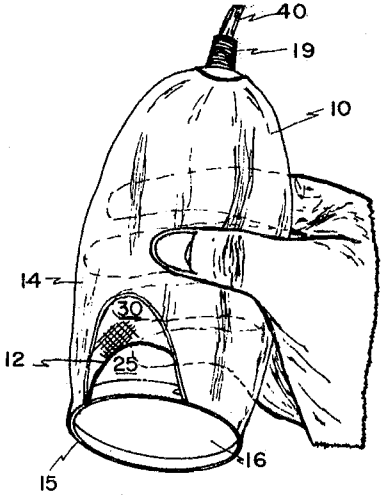
FIG. 1
FIG. 2
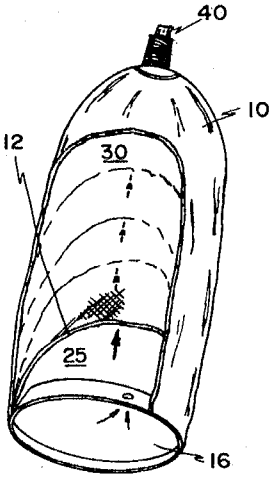
FIG. 3

DISPENSING CONTAINER WITH IMPROVED AIR VALVE

This invention relates to a container to dispense ingredients such as pastes, creams, and liquid sprays can be discharged from a suitable orifice or orifices.

Particularly it is a container that provides an improved and structurally simplistic air valve that employs as its operative element a segment of a resilient deformable membrane, the membrane selectively partitioning the container into an ingredient and an air chamber. The air chamber is located towards the middle of the container and the ingredients are easily dispensed because they are located adjacent to the outer housing. It is thus a dispensing container with an improved air valve and overcomes certain problems associated with my DISPENSING CONTAINER issued as U.S. Pat. No. 4,154,366 of May, 15, 1979. If a spring loaded discrete air valve is employed in this container, ingredient can be inadvertently exuded from the ingredient orifice when there is a sudden rise in ambient temperature or a sudden decrease in atmospheric pressure as when the container is in baggage located in an aircraft hold because of the increase in air chamber pressure relative to atmospheric pressure. My novel simplistic air valve closes only when the container is squeezed and thus this improved container is not sensitive to atmospheric changes in temperature and pressure.

The invention thus has as one of its objects the elimination of a discrete air valve having a spring loaded activated element, as is disclosed in said U.S. Patent and to replacement thereof by an orifice in the base portion of the container, together with reprofiling of the base portion and its inner face or margin with the sides of the container so as to provide a base aperture therein. An active element associated with the aperture; namely, a portion of the chamber separating membrane acts as the active element to convert a simple aperture into an unidirection flow valve that replaces the discrete spring loaded valve disclosed in my said U.S. Patent. It thus allows air to enter into the air plenum or chamber of the container after a squeeze, while inhibiting air from issuing from the air plenum during a squeeze. This novel simplistic air valve thus operatively closes only when the container is squeezed.

This object is achieved by using a pliable or resilient outer housing as the container, in combination with a resilient inner movable and deformable membrane, the membrane fixedly mounted peripherally about the lower extremity of the outer housing where that outer housing mates with or joins with the base or the bottom of the container. The base or bottom is not flat, but is slightly recessed so as to provide a circumferential edge and into this edge is defined an aperture. The container thus defines two non-communicating cavities, an ingredient cavity or plenum, and an air cavity or plenum, the air cavity or plenum communicating to the outside of the container through the orifice in the base, a portion of the membrane, which is essentially adjacently located near the orifice acts as an active valve element matingly closing the orifice when the container is squeezed and hence isolates the air plenum from the outside, whereby the squeezing elevates the pressure within the air plenum and causing excessive pressure on the ingredient plenum across the resilient membrane, forcing ingredients out an ingredient communicating orifice of the container.

Another objective of the invention is to provide suitable ingredient discharging orifices for a wide variety of flowable ingredients used in this container. An ingredient by its inherent cohesion (surface tension) and adherence to the ingredient orifice channel walls due to ingredient surface tension causes a plugging or blocking of the orifice channel during the recovery part of a cycle and during static conditions so that atmospheric air can not enter the ingredient chamber. This plugging or blocking effect holds the ingredient adjacent to the ingredient discharge orifice so that the ingredient is ready for instant use. The length, size and shape of the ingredient orifice channel is designed to cause this plugging or blocking.

Thus the invention contemplates an improved air valve for a dispensing container, the container including a resilient housing, a bottom and a resilient expandable membrane mounted between the housing and the bottom to internally partition the container into an ingredient dispensing chamber and an air chamber, the housing defining an ingredient dispensing orifice that communicates with the ingredient containing chamber, the improvement comprising:

(a) the bottom, formed to matingly seal marginal edges of the membrane with peripheral walls of the container, the bottom forming a recess with an inclined slope portion, the said inclined slope portion defining an aperture, the slope being positioned at an angle relative the housing, whereby on flexing of the housing, a portion of the membrane is caused to be sealingly urged against the orifice and hence to sealingly close the same whereby air in the air chamber is urged against the membrane to urge ingredients in the ingredient chamber out of the ingredient orifice.

The invention also contemplates a method of filling a container which includes a resilient housing, a bottom, a resilient expandable membrane mounted between the housing and the bottom to internally partition the container into an ingredient containing chamber and an air chamber, the housing defining an ingredient discharge orifice that communicates with the ingredient containing chamber; the method being a process of filling the same comprising the steps of (a) applying a vacuum at the ingredient discharge orifice to thereby cause the resilient membrane to deform and hence to increase the volume of the air chamber relative the ingredient containing chamber to such a substantial extent that the volume of the ingredient containing chamber is relatively small; then, (b) injecting into the ingredient discharge orifice a suitable ingredient such that the same occupies the ingredient containing chamber to an increasing extent whereby the volume of said chamber is increased displacing the equivalent volume of the air chamber until the air chamber is relatively void, and the ingredient containing chamber full.

The invention will now be described by way of example and reference to the accompanying drawings in which:

FIG. 1 is a perspective view, partially in section, of a container, showing the orifice in the bottom thereof, and with a discharge orifice having engaged thereon a sealed captive cap.

FIG. 2 is a perspective of FIG. 1, cap removed during initial squeeze.

FIG. 3 is the perspective of FIGS. 1 and 2 showing the migration of the internal membrane.

FIG. 4 is a plane view of an oval shaped container showing the preferred location of the air aperture 18. The arrows A,A indicate the preferred direction of squeeze over the more flat sides of this oval shaped container.

FIG. 5 is a partial section of the container, across the (air) orifice during squeezing of FIG. 2.

Figure 6A:
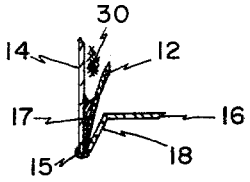

FIG. 6*a* is an attenative structure of orifice and membrane along identical cross section to that of FIG. 6.

FIG. 6 is the section of FIG. 5 during non-squeezing of FIG. 1.

Figure 7:
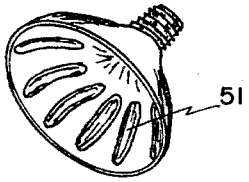

FIG. 7 is an idealized internal profile, of the discharge orifice and peripheral of the container only.

Figure 8:
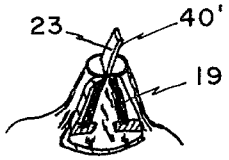

FIG. 8 is a perspective section of one type of ingredient discharge orifice used to dispense gels and greases.

Figure 9:
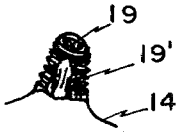

FIG. 9 is another embodiment of discharge orifice.

Figure 11:
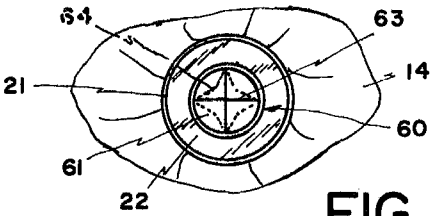
Figure 10:
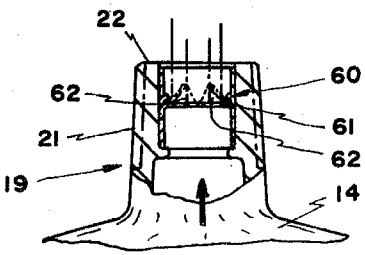

FIGS. 10 and 11 are elevation and plane views respectively of an alternative embodiment of ingredient discharge orifice.

Figure 13:
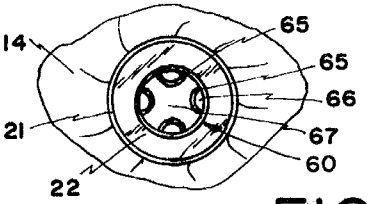
Figure 12:
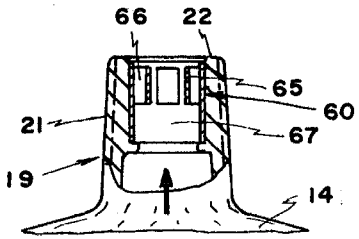

FIGS. 12 and 13 are elevation and plane views respectively of yet another ingredient discharge orifice.

Figure 15:
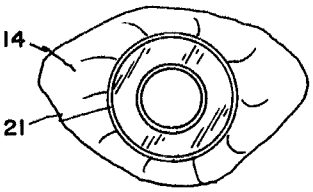
Figure 14:
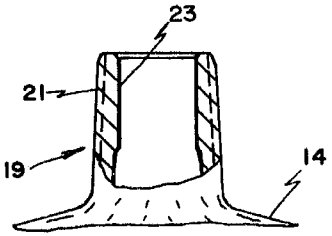

FIGS. 14 and 15 are elevational and plane views of the discharge orifices of FIGS. 1 and 9.

Figure 16:
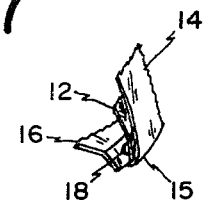

FIG. 16 is a perspective view of the structure of FIG. 6 with parts broken away.

Referring now to FIG. 1, a container 10 includes a resilient housing composed of conventional resilient plastic material that is formed into essentially the shape of a container or bottle 14. The container has affixed thereto, as a bottom 16, and the bottom is recessed as shown. The recess of a bottom is preferably about the whole marginal interface of the bottom 16 with the bottle 14, as shown, but this need not be so. In that respect, the inclined circumferential rim 16′ of the bottom defines an acute angle with the wall 14 and preferably an angle therebetween which is less than 45°. In a portion or segment of this inclined rim 16′, an orifice 18 is positioned.

The bottle portion 14 and the base or bottom 16 are affixed to each other by a circumferential bead 15 more clearly seen in FIGS. 5 and 6. This bead 15, clamps, into matingly engagement, the bottom margin of the bottle 14, and of the base 16, and clasps therebetween, the margins of a resilient expandable flexible membrane 12, more clearly seen in FIGS. 1, 2 and 3. That membrane 12, partitions, internally, the container into a lower air chamber 25 that communicates with the aperture 18 to the outside of the container, and an ingredient containing chamber 30, which communicates with an ingredient discharge orifice generally indicated as reference 19 in FIGS. 2, 3 and 8 through 14.

In the operation the bottle may be squeezed as at FIG. 2 and the outside portion of the bottle near the bottom portion indicated as A presses against the membrane 12 and hence presses the membrane 12 against the orifice 18 closing the same. This thus isolates and seals the air chamber 25 from the outside so that on further squeezing, the air pressure in the air chamber 25 urges against the expandable flexible membrane 12 and hence on the contents in the ingredient chamber 30. The ingredients 40 exude out from the orifice 19. On releasing, of the container or bottle the region A folds back away from the orifice 18 allowing air to enter through the orifice 18 into the air chamber 25 and hence re-equalizing the respective internal chambers—see FIG. 6. That is, the volume at atmospheric pressure in the air chamber is taken up by air flowing from the atmosphere through aperture 18 into the air chamber 25. On repeated squeezes the cycle is repeated.

Referring to FIG. 6*a* preferably the membrane 12 in the region of the orifice 18 is attached by a resilient web 17 to the lower wall portion of the housing 14. The web 17 acts as means to pull back the membrane 12 from its juxtaposed relation over the aperture when the container, after a squeeze, is released and becomes unsqueezed. It has been found that without the web 17 the membrane has a tendency, sometimes, to adhesively stick onto the orifice and to keep the orifice 18 closed after the squeeze. This may be noticeable when the ingredient chamber is nearing its minimum volume.

There may be internally disposed about the shoulder of the bottle, near the orifice 19, ribs 51 and these ribs help in tracking the ingredient within the ingredient chamber 30 to flow out of the ingredient discharge orifice to totally purge the ingredient chamber as when the container is being terminally emptied of its ingredients. On the other hand, during initial ingredient discharge, as when the container is full—for instance FIG. 1—the ribs 51 serve no useful ingredient purging purpose.

Various ingredient orifice discharge structures 19 may be used depending on the viscosity of the ingredient to be contained. In FIGS. 1, 2, 3 and 7 the discharge orifice 19 is simple and more particularly may consist, as shown in FIGS. 14 and 15, of a simple single extended channel 23 which communicates through a fairly long stem 21 formed by the ingredient discharge surround. This particular orifice is useful when the ingredients within the ingredient chamber are cohesive ingredients such as grease, vaseline and some gels because the molecular cohesion and the surface tension between the ingredient and the walls 21 provide the necessary mechanics by which the ingredient may be continually discharged out the ingredient discharge orifice 19 without air penetrating into the ingredient chamber 30 as when container is allowed to be "unsqueezed" after a squeeze. This is manditory so that the ingredient discharge orifice mechanical profile features in cooperation with the viscosity and surface tension of the ingredient against the internal walls of discharge orifice 19 provide the property that on a release of the container (after it has been squeezed) ingredient resident in the discharge orifice 19 not vacate so as to permit air to enter into or to "back fill" the ingredient chamber 30.

FIG. 8 is another embodiment of an ingredient discharge orifice which is also suitable for cohesive ingredients such as grease, vaseline and some gels. It comprises two oppositely disposed angulated flexible lips 19′ which relatively part away from each other to allow ingredient 40′ to be expelled from the orifice 19. Typically such flexible lips might be composed of any resilient material such as rubber or flexable polyethelene.

FIGS. 10 and 11 are elevation and plane views respectively of an ingredient discharge orifice suitable for a wide range of ingredients from hand lotion to dental creams. A practical embodiment of this ingredient orifice employs a rubber or other resilient washer 60 jammed or otherwise affixed at the bottom of an ingredient discharge well. Cross slits 63 in the washer form movable flaps which part when the container 10 is squeezed. A single slit may be used but I prefer cross slits as seen in FIG. 11. Ingredient resident in the ingredient well after a squeeze overlays the slits 63 during container recovery and static conditions of the container so that atmospheric air does not enter the ingredient chamber 30.

FIGS. 12 and 13 are elevation and plane views respectively of another embodiment of discharge orifice 19 comprising a plurality or family of peripheral orifices 66 bounded by walls or channels 65 that themselves define a central orifice 67 all of which comprise the discharge orifice. From the family of orifices, thin liquids may be discharged in the form of a spray similar to that of an atomizer. Orifice discharge channels 65 and central orifice 67 are sized as capillary tubes for the liquid ingredient to be contained. The surface liquid cooperates with these capillary channels and prevents the entry of atmospheric air into the ingredient chamber during squeeze recovery and static conditions of the container.

Since my novel simplistic air valve closes only as the container is squeezed, this improved container may be used conveniently to easily fill, through the open ingredient orifice 19, the ingredient chamber prior to the container and its ingredients being sold commercially. This is achieved by first causing the resilient deformable membrane 12 to become erect. This may be conveniently accomplished by first applying a vacuum to the open discharge orifice 19 to cause the resilient membrane to become erect and to urge against the total interior walls of the container and to come into relative juxtaposition with the ingredient discharge orifice 19. This essentially eliminates the totality of the ingredient chamber by displacing that volume with the air chamber. Then, subsequently ejecting or forcing ingredient 40 from an appropriate filling nozzle into the open ingredient orifice 19 to fill the ingredient chamber 30 and hence to evacuate and replace the volume of the air chamber 25 until the air chamber 25 becomes essentially non-existent. After filling, the container and its ingredients are removed and the appropriate cap for the discharge orifice 20 mounted so as to temporarily seal the container thereby allowing the container and its ingredients to be packaged for distribution and selling to the public or others users.

The embodiments of the invention in which an exclusive property or privilege is claimed are defined as follows:

1. An improved air valve for a dispensing container, the container including a resilient housing, a bottom, and a resilient expandable membrane mounted between the housing and the bottom to internally partition the container into an ingredient dispensing chamber and an air chamber, the housing defining an ingredient dispensing orifice that communicates with the ingredient containing chamber, the improvement comprising:

(a) the bottom formed to matingly seal marginal edges of the membrane with peripheral walls of the container, the bottom forming a recess and having an inclined sloped portion, an aperture formed in said inclined sloped portion, the sloped portion forming an acute angle with the housing, whereby on flexing of the housing, a portion of the membrane is caused to be sealingly urged against the aperture and hence to sealingly close the same whereby air in the air chamber is urged against the membrane to urge ingredients in the ingredient chamber out of the ingredient orifice.

2. The dispensing container as claimed in claim 1 wherein the ingredient discharge orifice consists of a plurality of capillaries communicating the ingredient chamber to the outside.

3. The container as claimed in claim 1, wherein the ingredient discharge orifice is a cylindrical channel of predetermined extent which communicates the ingredient chamber to the outside of the chamber.

4. The container as claimed in claim 1 wherein the ingredient discharge orifice consists of a cylindrical channel communicating the ingredient chamber to the outside and a flexible membrane positioned across the channel to divide the channel into two parts, the membrane defining a cut therethrough and being resilient such that ingredient when urged against one side of the membrane deforms the membrane so as to exude out of the slit whereby passing of ingredient from the ingredient chamber to the outside is achieved.

5. The improvement as claimed in claim 1, said membrane being attached to said housing in the region of said aperture by resilient means which normally holds said membrane spaced from said aperture.

* * * * *